United States Patent [19]

Jacobson

[11] 4,196,844

[45] Apr. 8, 1980

[54] CLOSING STRUCTURE FOR CENTRIFUGE VACUUM CHAMBER

[75] Inventor: Kenneth E. Jacobson, Fremont, Calif.

[73] Assignee: Beckman Instruments, Inc., Fullerton, Calif.

[21] Appl. No.: 20,892

[22] Filed: Mar. 15, 1979

[51] Int. Cl.[2] ..... B04B 7/06

[52] U.S. Cl. ..... 233/1 B; 220/345; 233/13

[58] Field of Search ..... 233/1 B, 1 A, 1 R, 14 R, 233/13; 220/345, 346

[56] References Cited

U.S. PATENT DOCUMENTS

| | | | |
|---|---|---|---|
| 3,111,863 | 11/1963 | Filz | 233/1 B |
| 3,327,938 | 6/1967 | Stallmann | 233/1 R |
| 3,391,862 | 7/1968 | Jacobson | 233/13 |
| 3,747,841 | 7/1973 | Ross | 233/1 B |

*Primary Examiner*—Robert W. Jenkins

*Attorney, Agent, or Firm*—R. J. Steinmeyer; F. L. Mehlhoff; T. J. Plante

[57] ABSTRACT

A closing structure for the top of a centrifuge chamber comprising a door which is slidable horizontally toward and away from closed position, a retaining member above the door which permits a limited upward movement of the door, side members which surround the closed door on three sides to contain shrapnel from a rotor failure, and a flange extending downwardly from the door on its fourth side to contain shrapnel.

4 Claims, 5 Drawing Figures

CLOSING STRUCTURE FOR CENTRIFUGE VACUUM CHAMBER

BACKGROUND OF THE INVENTION

This invention relates to the structure of centrifuge vacuum chambers, and particularly to the means for closing and securing such a chamber during operation of the centrifuge.

As shown in Jacobson and Taylor U.S. Pat. No. 3,391,862, issued July 9, 1968 and assigned to the assignee of this application, a centrifuge vacuum chamber may have a top opening which is closed by sliding a door horizontally into position to provide a sealed cover for the opening. In order to protect the sealing element which encircles the opening, the door should be lowered onto the seal after, or raised above the seal before, its horizontal motion occurs.

One of the design requirements for safety of such a centrifuge chamber is provision of means for preventing fragments, or "shrapnel", from flying out of the chamber in the event of an explosion inside the chamber. Such an explosion might be caused by rotor failure due to corrosion of the aluminum rotors. Since the design of the horizontally movable door requires some vertical clearance in order to permit the door to be lowered onto the sealing member, an explosion inside the chamber will lift the door sufficiently to permit fragments to escape around the periphery of the opening.

Heretofore, the solution of this "shrapnel" problem has been the provision of a "shrapnel shield", secured to and fully enclosing the entire open end of the space provided for the door. Such a shield is cumbersome and bulky, particularly because it must provide a large enough enclosure to allow for the horizontal movement of the door required to fully uncover the chamber opening. The phantom lines shown in FIGS. 1 and 3 of the drawings herein illustrate a shrapnel shield of the type which has been in use for a number of years prior to this invention.

SUMMARY OF THE INVENTION

The present invention provides a simple, but very effective, solution of the "shrapnel" problem by using a "labyrinth" concept to prevent lateral escape of fragments due to an explosion. The closed chamber door is surrounded on three sides by a wall structure, which is open on the fourth side to accommodate horizontal movement of the door between its closed and opened positions. The fourth, or open, side is effectively protected from shrapnel by a flange carried by the edge of the door, which flange extends downwardly to overlie the side of the chamber structure by a distance greater than the available vertical movement of the door.

DETAILED DESCRIPTION OF THE PREFERRED EMBODIMENT

Figure 5:
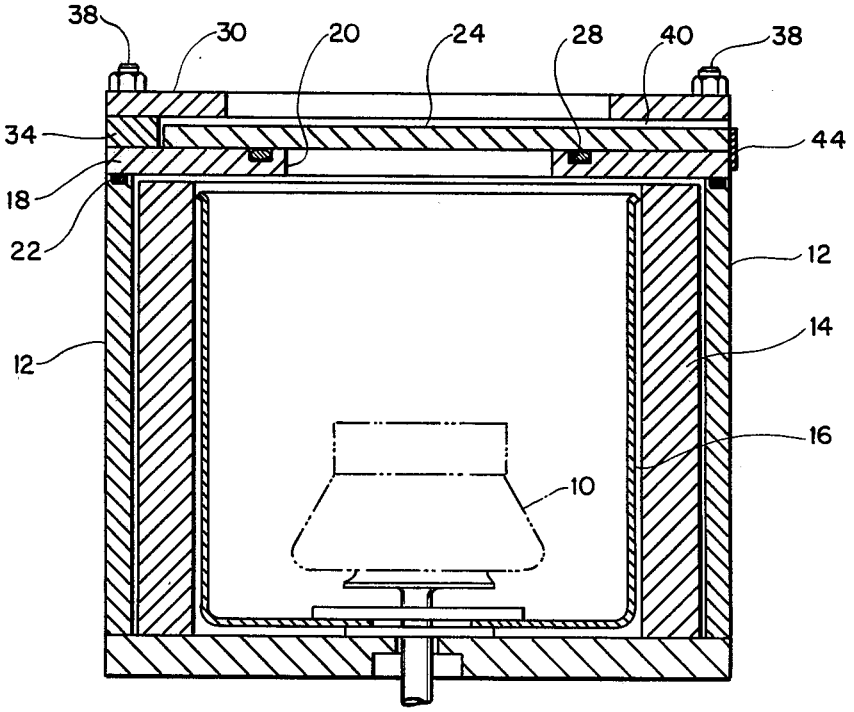
FIG. 5 is a vertical section through a complete centrifuge structure incorporating the invention.

The overall centrifuge structure shown in the figures is best understood from FIG. 5, wherein a rotor portion 10 is shown mounted inside a stationary chamber, which is evacuated during centrifuge rotation. The chamber walls may comprise an outer wall 12, a heavy guard ring 14 which protects against injury or damage in the event of rotor failure, and a refrigeration liner 16.

The chamber closing structure, which is of primary interest in the present invention, is mounted on top of the vacuum chamber. It includes a fixed top plate 18 supported on the outer wall 12 and having a center opening 20 which permits access to the vacuum chamber when the movable cover is in its open position. The contact of fixed top plate 18 with outer wall 12 is sealed by a sealing ring 22 made of suitable compressible material.

The top of the vacuum chamber is opened and closed for loading and unloading by means of a movable cover, or door, 24, which is moved horizontally toward and away from its chamber closing position. Such movement is facilitated by two rails 26, which support and guide the door 24 during its horizontal movement. As seen in the figures, the door 24 is pushed to the right to open the top of the vacuum chamber, and to the left to close it. In closed position, the door seals the vacuum chamber by engaging, and resting on, an annular sealing ring 28 carried in a groove in the fixed top plate 18. The door should be associated with both friction-reducing means, such as roller bearings, to facilitate its horizontal motion, and also camming means for controlling the raising and lowering of the door onto the sealing ring 28. Neither the friction-reducing means nor the camming means are shown in the drawings.

A fixed retaining member, or plate, 30 is provided to limit upward motion of the door 24, in the event of an explosion inside the vacuum chamber due to rotor failure. On three sides the fixed retaining member 30 is supported by an essentially U-shaped wall structure, which conveniently may comprise three blocks, or side bars, 32, 34 and 36, each extending along one side of the space in which the door is confined in its closed position. These three side bars surround the door on three sides, performing the dual function of supporting the fixed retaining member 30, and also enclosing the door on three sides to prevent any fragments, or shrapnel, from being exploded out of the chamber on any of the three sides enclosed by the side bars. The entire fixed structure of the vacuum chamber housing, including the two plates 18 and 30, may be vertically secured by a plurality of heavy vertically extending bolts 38.

It is necessary to permit some vertical motion of the door 24 as it moves toward and away from engagement with sealing ring 28, in order to prevent abrading of the sealing ring by friction against the horizontally moving door. This requires a minimum clearance space 40 between the top of door 24 in its closed position and the lower side of the fixed retaining plate 30. This space permits door 24 to be forced upward if a rotor explosion occurs in the chamber, thereby uncovering an opening at the right side of the top of the chamber through which fragments might escape.

In order to avoid the danger and damage caused by such explosion fragments, it has heretofore been the practice to use a shrapnel shield, or metal envelope, surrounding the open end of the door-containing space.

Figure 1:
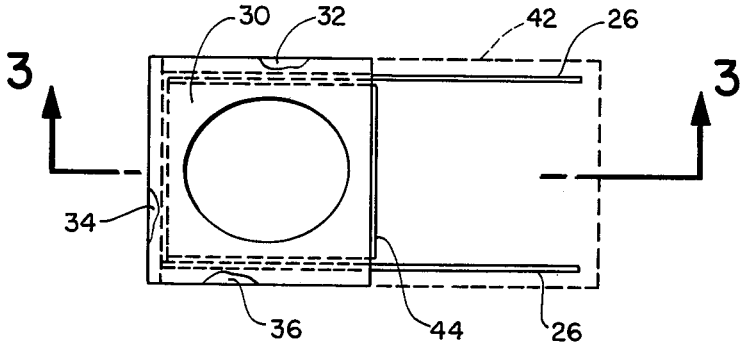
FIG. 1 is a plan view of a centrifuge chamber incorporating the present invention, and also showing in phantom the outline of a prior art shrapnel shield.
Figure 2:
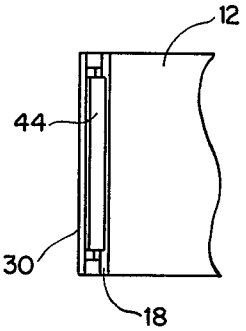
FIG. 2 is an end view of the structure shown in FIG. 1.
Figure 3:
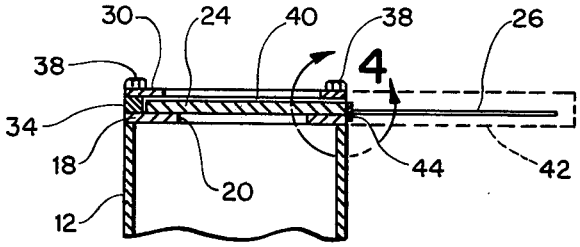
FIG. 3 is a vertical section through the top portion only of the same centrifuge structure.
Figure 4:
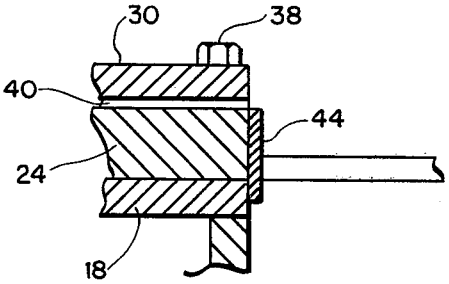
FIG. 4 is a closeup of the shrapnel containment flange of the present invention.

Such a shield is shown at 42 in phantom lines in FIGS. 1 and 3. It has to be large enough to enclose the projecting rails 26, and it has to be securely fastened to the wall structure of the vacuum chamber. If the door needs to be entirely disassociated from the vacuum chamber at any time for repair or replacement, it is necessary to remove the shield 42, which necessitates removing the bolts, or other fastening means, securing the shield to the vacuum chamber.

A radical simplification of this structure, which is particularly valuable because of its extreme simplicity, is the means provided by the present invention for shrapnel containment on the open end of the cover space. By providing a downwardly extending flange, or bar, 44 secured to, or integral with, the right end of the door 24, I create a "labyrinth" effect, which effectively shields the gap, and prevents shrapnel from flying out of the chamber. The flange 44 extends horizontally the full length of the right end of the door, and extends downwardly far enough to overlie the nearest outer surface of the vacuum chamber a distance greater than the vertical distance between the top of the closed door 24 and the lower face of the fixed retaining plate 30. With this very simple and inexpensive arrangement, protection from fragment escape is provided, and this benefit is obtained by a simple structural addition to the movable cover, or door. Thus the special shielding envelope is dispensed with, and there is no need to laboriously remove the protective structure when the door needs to be taken away from the vacuum chamber structure.

What is claimed is:

1. In a closure for a centrifuge vacuum chamber having an opening at the top and a horizontally movable door for closing the opening during operation of the centrifuge, means for preventing the escape of fragments created if an explosion occurs in the chamber, comprising:

a fixed wall structure extending upwardly from the top of the chamber to substantially surround the closed door on three sides, while permitting it to be moved horizontally through the open side toward and away from its closed position;

a fixed retaining member extending horizontally above the door to limit upward movement of the door if it should be forced up from its closed position; and a flange carried by the door and located at the open side of the wall structure, said flange overlying the top of the chamber by an amount greater than the distance between the top of the door and the retaining member.

2. A closure structure, for a centrifuge chamber having an opening at the top, comprising:

a cover movable in a generally horizontal direction toward and away from said opening;

a fixed retaining member above the cover which permits a limited upward movement of the cover;

fixed containment means on three sides of the closed cover for preventing horizontal escape of fragments from the chamber if a structural failure occurs; and movable containment means at the fourth side of the closed cover for preventing horizontal escape of fragments, said movable means being supported by and movable with the cover as it is moved between its opened and closed positions.

3. The closure structure of claim 2 wherein the fixed containment means comprises three bars which lie on top of the chamber along three edges thereof and which provide support for the fixed retaining member.

4. The closure structure of claim 2 wherein the movable containment means is a downwardly extending flange which overlies the nearest side of the chamber by an amount exceeding the distance between the top of the cover and the adjacent surface of the fixed retaining member.

* * * * *